US006460364B1

(12) United States Patent
Tufo

(10) Patent No.: US 6,460,364 B1
(45) Date of Patent: Oct. 8, 2002

(54) CONTROL UNIT FOR AIR-CONDITIONING

(75) Inventor: Joseph John Tufo, Surrey (GB)

(73) Assignee: Diffusion Environmental Systems, Limited, Surrey (GB)

( * ) Notice: Subject to any disclaimer, the term of this patent is extended or adjusted under 35 U.S.C. 154(b) by 0 days.

(21) Appl. No.: 09/787,460

(22) PCT Filed: Aug. 10, 1999

(86) PCT No.: PCT/GB99/02630

§ 371 (c)(1),
(2), (4) Date: Feb. 9, 2001

(87) PCT Pub. No.: WO00/09955

PCT Pub. Date: Feb. 24, 2000

(30) Foreign Application Priority Data

Aug. 10, 1989 (GB) ..... 9817387

(51) Int. Cl.[7] ..... F25D 21/14
(52) U.S. Cl. ..... 62/285
(58) Field of Search ..... 62/DIG. 16, 259.1, 62/285

(56) References Cited

U.S. PATENT DOCUMENTS 4,563,943 A * 1/1986 Bertelsen ..... 98/115.1
5,522,229 A 6/1996 Stuchlik, III et al.
5,622,058 A 4/1997 Ramakrishnam et al.
5,732,565 A 3/1998 Ramakrishnam et al.
5,911,747 A * 6/1999 Gauthier ..... 62/176.6
5,943,872 A * 8/1999 Sakurada et al. ..... 62/262
5,979,167 A * 11/1999 Kochavi et al. ..... 62/186
6,062,482 A * 5/2000 Gauthier et al. ..... 62/231

FOREIGN PATENT DOCUMENTS

| | | | |
|---|---|---|---|
| DE | 29514189 | 11/1995 | |
| EP | 453302 | 10/1991 | |
| EP | 706015 | 4/1996 | |
| EP | 769661 | 4/1997 | |
| GB | 1351436 | 5/1974 | |
| GB | 1555563 | 11/1979 | |
| GB | 2155616 | 9/1985 | |
| GB | 2166863 | 5/1986 | |
| GB | 2314924 | 1/1998 | |
| JP | 11159856 A * | 11/1997 | ..... F24F/13/32 |
| JP | 2000-134862 A * | 10/1998 | ..... F24F/1/00 |

* cited by examiner

*Primary Examiner*—William E. Tapolcai
*Assistant Examiner*—Mohammad M Ali
(74) *Attorney, Agent, or Firm*—Caesar, Rivise, Berstein, Cohen & Pokotilow, Ltd.

(57) ABSTRACT

An air conditioning unit comprises at least a fan, a circuit containing water, a condensation collection unit and an air filter together with process logic means to monitor the speed of rotation of the rotary fan to sense the condition of the other components and to activate an alarm in the event that the condition of any one component deviates from a predetermined status.

11 Claims, 5 Drawing Sheets

CONTROL UNIT FOR AIR-CONDITIONING

The Invention relates to air conditioning and in particular to the air conditioning of individual rooms in multiple occupancy buildings such as hotels or the like. Such conditioning may be to heat or cool the room or otherwise provide comfort.

In one popular installation an air conditioning unit is fitted in the ceiling of the lobby of each hotel bedroom. This location is chosen because the unit does not obstruct other equipment and does not take up usable wall space. The unit is made up of separate components such as a fan motor; cooling unit; and the like. These units will need treatment from time to time; for example the air filter will need to be cleaned or replaced when it is clogged with dust particles. Components will fail from time to time and when that happens a service engineer must visit to identify the defect and organise a repair or replacement. Until that happens the hotel management may well refuse to allow the bedroom to be occupied by a guest which is a loss of revenue to the hotel. Even when the service engineer comes to the hotel the room may be occupied by a guest, so the engineer may have to loiter until he can gain access. Even when he can inspect the installation he will need considerable skill because the components are unlikely to be easily accessible.

It is a first object of this invention to provide an air conditioning unit which will offer the hotel management considerable economic advantages. It is a second object to provide such a unit which is easily repaired so cutting down the time required by the service engineer to make and complete his visit. A third object of the invention is to provide such a unit incorporating diagnostic means so that repair and replacement may be carried out before there is an emergency allowing the service engineer to visit in ordinary working hours and by pre-arrangement The invention is based on the realisation that it is advantageous to monitor the condition of each component in the unit in the individual room, so that intelligent information can be derived therefrom. The second realisation is that each component should be made individually accessible (and preferably removable) with ease.

According to the invention in one aspect there is provided a multi-room building, each room having an air conditioning unit for controlling the environment therein, the unit comprising components comprising:

fan means;

circuit means containing water;

a condensation collection unit;

air filter means; and process logic means arranged to monitor the condition of one component characterised in that the unit is mounted in the ceiling of the room, the unit comprising a housing containing the components and the process logic means the housing having a door through which there is access to the components and process logic means, each component being independently releasably mounted in the housing whereby each is individually replaceable.

It is known to monitor the condition of the components of an air conditioning unit from, for example EP 0453302A and EP 0706015A. It is also known from JP 59122829A to compare the actual rotational speed of a fan of an air conditioning unit with predetermined values and to use the sensed information to decide whether or not the associated filter is sufficiently dirty to need to be replaced.

Preferably the process logic means is arranged to monitor the speed of rotation of a rotary fan, and derive from that sensed information the level of contamination of the filter means.

Depending on the location of the building the occupant may want to heat and/or cool the room (as in Northern climates) or just to cool it, as in the Middle East. The circuit containing water may thus be a heating circuit or a cooling circuit; both may be present in one unit.

In another aspect there is provided a unit for conditioning a room in a multi-room building, the unit containing components comprising:

fan means;

a heating circuit containing circulating hot water;

a cooling circuit containing circulating cooling water;

a condensation collection unit; and process logic control means arranged to monitor the condition of each component and to activate an alarm in the event that the condition of any component deviates from a predetermined status.

In yet another aspect the unit is mounted in the ceiling of a lobby of a hotel bedroom, and access to the unit is by means of a hinged door, and the process logic means is mounted in a drop down frame therefor, whereby the process logic means is accessible when the door is open.

Preferably the control means is arranged to check the function of components of the unit and to provide an alert or alarm signal in the event of a failure or need for a replacement. Such components include a variable speed motorised fan, a transformer for varying the voltage supplied to the motor for the fan, a heat exchanger and an air filter. Most preferably the control means is arranged to signal a malfunction at a remote location, so that unnecessary site visits are avoided.

Within the housing behind the fan device there is a heating coil, together with a damper device and this assembly is used to control the level of heating on demand. A cooling coil and damper assembly which operates in much the same way is also present.

The unit includes a heat exchanger of a suitable design. Preferably the coils are arranged for multi-circuit operation.

The unit may include a condenser drain pan or drip tray having a lift pump.

The air filter may be made of metal or natural or synthetic fibre. This will need cleaning or replacement from time to time.

The controls preferably comprise:

an air sensor fitted in the return air stream to ensure that the true room air temperature is sensed and then to provide a signal to the controller in collaboration with a room dial plate to drive an actuator to modulate damper means present in the unit to maintain the pre-set air temperature;

diagnostic circuits to sense and activate e.g. sound an alarm signal in the event of a failure or threatened failure for one or more of the following components:

fan motor transformer filter element level of water in the condenser tray, and when room window is open when the room door is open when the access panel is open The controls may be provided with LEDs to be lit up when there is a problem, e.g. to be noticed by a maid or hotel guest who will then ask the management to call a service engineer. An advantage of the invention is that the signal may be connected by wire to a central location.

In another aspect there is provided a unit for heating or cooling a room in a building as defined, the unit including fan means and a condensation tray to collect condensate formed in use of the unit, the unit being adapted to be suspended in the ceiling by rod means depending from the overlying structure and passing through holes in the bounds of the housing including adjustment means for mounting the unit in an assigned area in the ceiling and locating the unit generally horizontal for collection of condensate in the condensation tray by gravity.

In order that the invention may be well understood it will now be described with reference to the accompanying diagrammatic drawings, in which.

Figure 1:
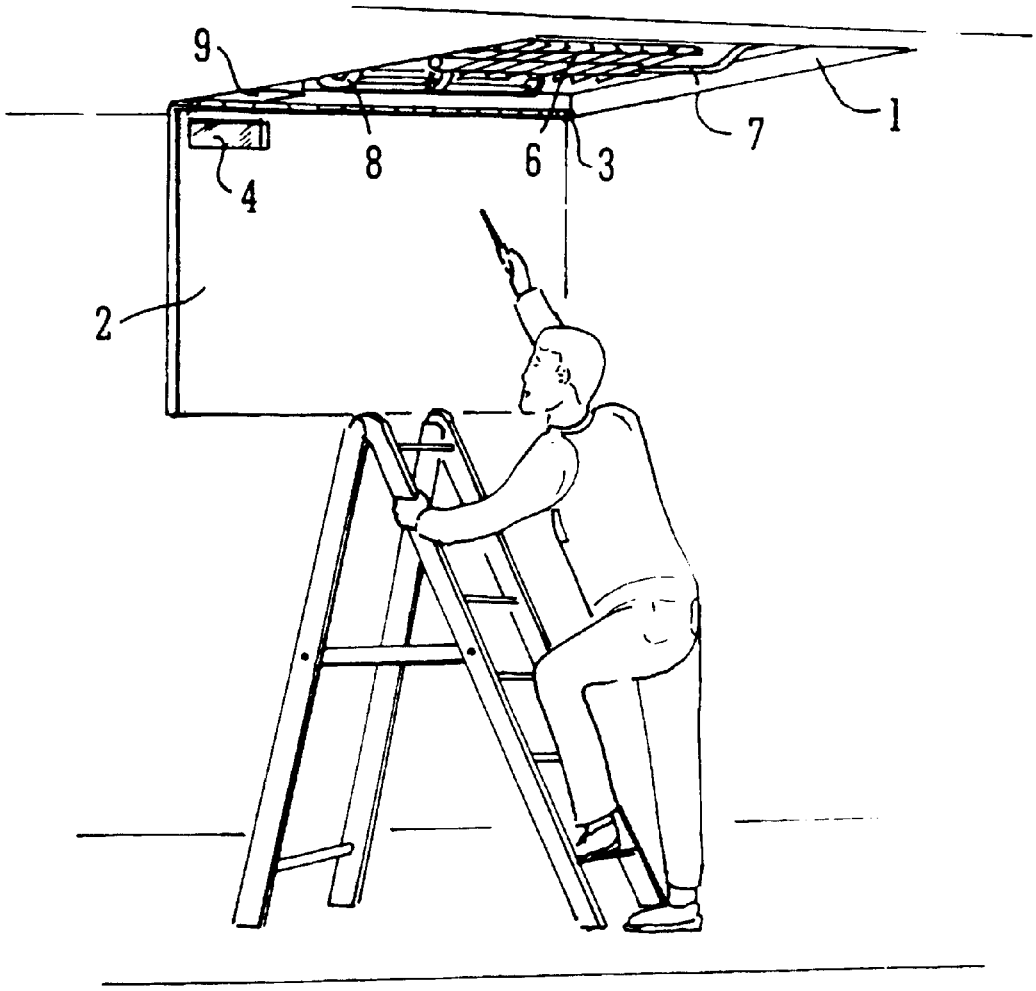
FIG. 1 is an elevation showing one air conditioning unit of the invention in the ceiling of a hotel a bedroom lobby opened by a service engineer for maintenance.
Figure 2:
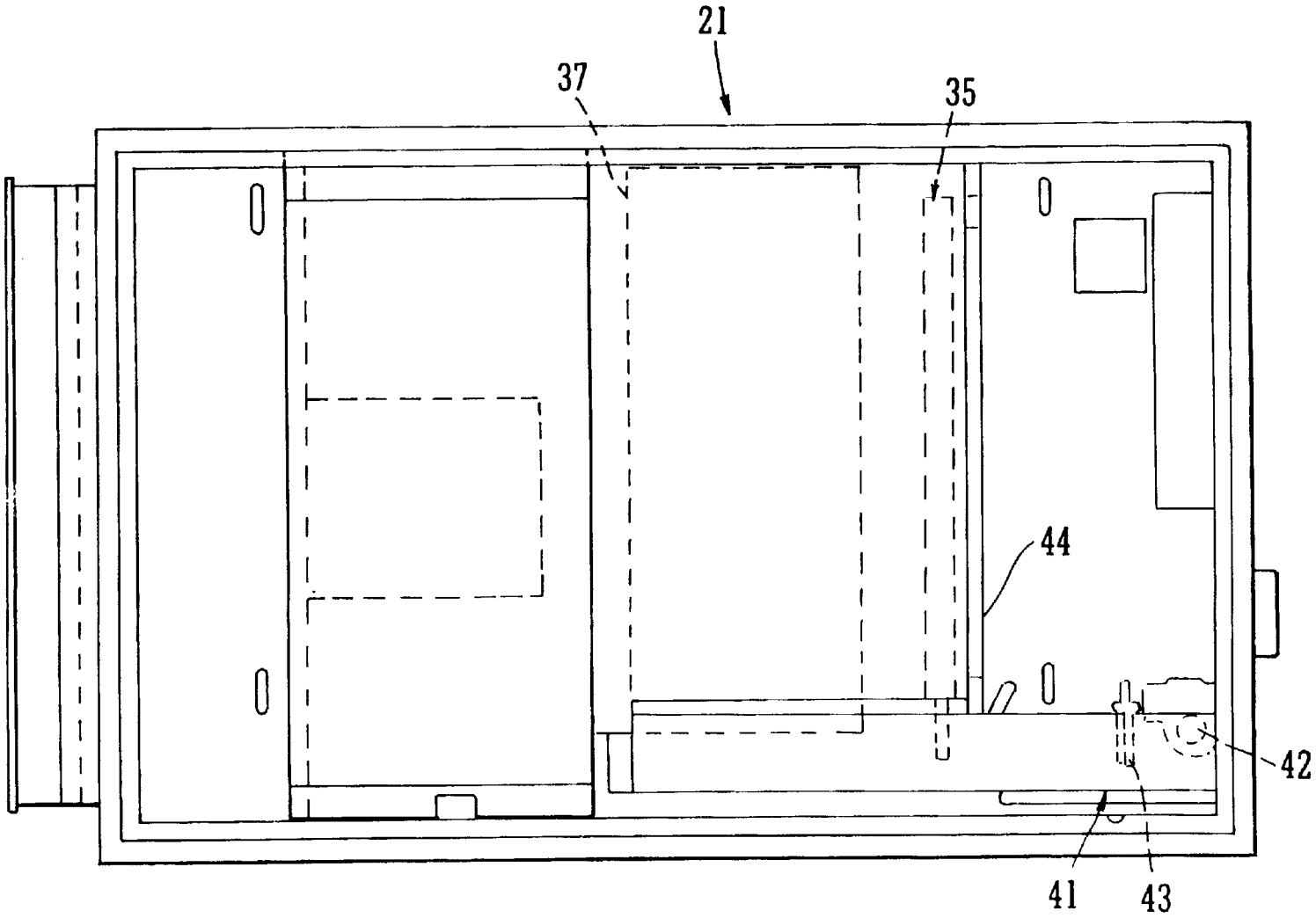
FIG. 2 is a plan view of the interior of one unit, seen from the underside.
Figure 3:
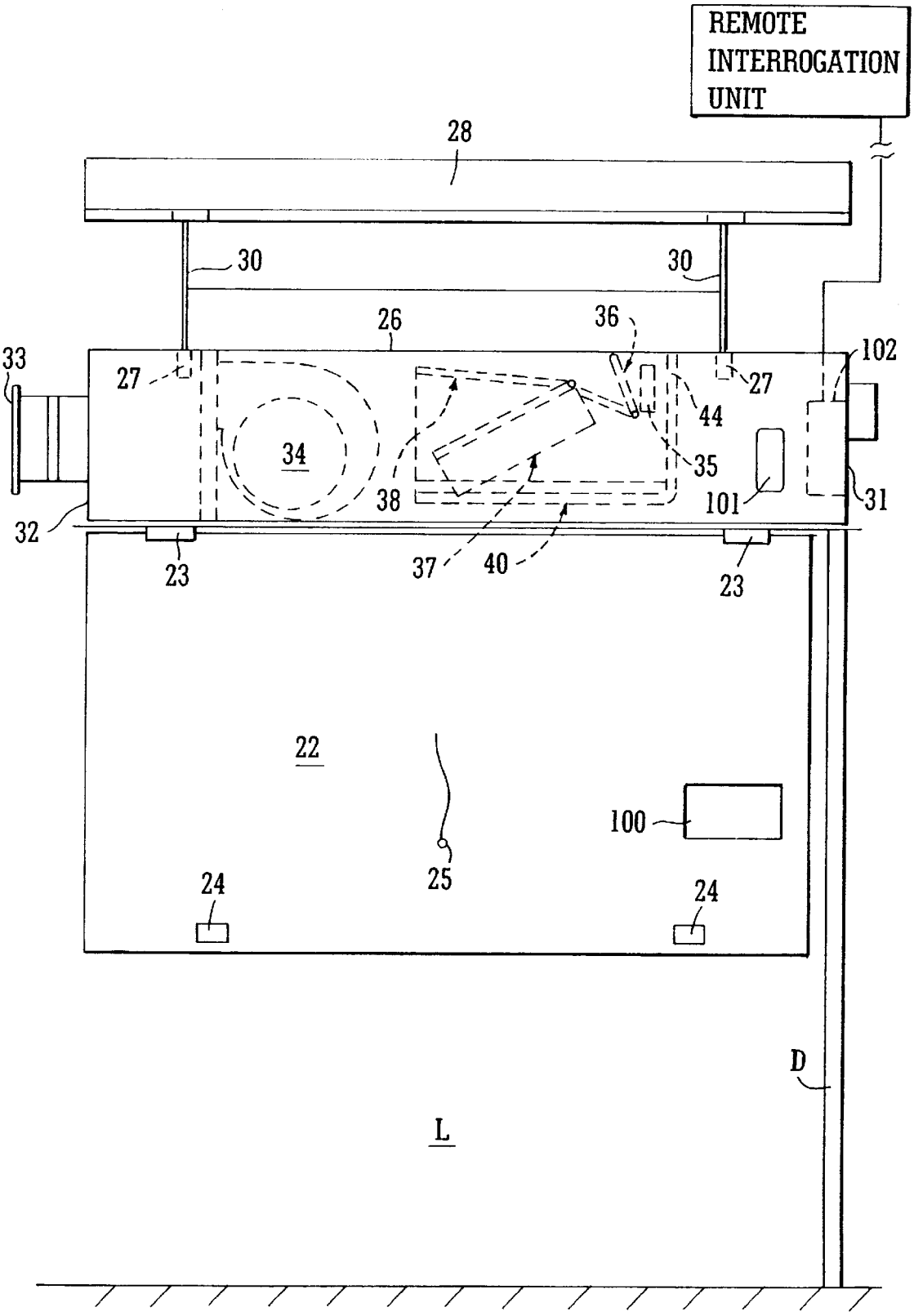
FIG. 3 is a side elevation of the unit of FIG. 2 in the ceiling of the lobby of a bedroom, in the open condition.

As shown in FIG. 1 the air conditioning unit comprises a housing or box 1 having a lid 2 hinged to the housing at one end 3. The lid 2 is held in place by a push fit latch which may be key operated. The lid has a grille 4 through which warning lights e.g. LEDs 5, may be visible. The box contains at one end a water cooling heat exchanger unit 6, which extends across the box near its longitudinal centre. The pipe work 7 for the cooling unit is present in one half of the box and a fan motor and assembly 8 is present in the other. A control box 9 is present and has a number of switches each in the form of a push button.

A fan and motor assembly 8 is fitted with a high output permanent split capacitor continuously rated external rotor motor with built-in thermal overload protection complying with BS5000, 1973, Part 2. The motor frame is totally enclosed and fitted with maintenance-free sealed for life sleeve bearings. Motors are insulated to BS2757 (Class F). The fan scrolls are double inlet, double width, centrifugal type aluminium impellers. All fan and motor assemblies are statically balanced to prevent the transmission of vibration and the complete assembly is fitted with neoprene rubber mounts.

The fan coil unit is set to operate at 3 speeds, i.e. low/medium/high. The speed control is achieved by variation of the voltage onto the fan motor, via relays or triacs and a multi-tapped transformer. Speed control with 1,2,3, positions is incorporated in the room control plate, not shown. This enunciates the desired speed and temperature with coloured LEDs.

The coils of the heat exchanger 6 are manufactured from solid drawn copper tube mechanically expanded into accurately pre-formed collars in aluminium fins. The coils are for multi circuit water operation with headers. Each coil is fitted with extended accessible combined pressure test point air vent and combined pressure test drain point. All coils are suitable for operating pressure up to 12 bar static head. They are fitted with 15 mm Union connections.

The box also contains automatic balancing valves to regulate the water flow to a preset value commissioning valves for heating and cooling. The unit is fitted with accessible isolating ball valves with "T" lever handles. The unit pipework is assembled with staggered Union fittings to enable easy removal of all components from within the unit access panel.

A condensate drip tray is present. This is manufactured from 1.2 mm hot dipped galvanised steel welded at each corner. The tray is degreased before an anti-condensation insulation is applied to all internal and external surfaces. The tray has a silent 400 mm condensate lift pump arranged to ensure all condensate is pumped effectively. The controller is arranged to energise the pump, when it senses it is dehumidifying.

The tray also houses a replaceable air filter 10 manufactured from a fine woven mesh of galvanised steel welded to a rigid galvanised steel frame and painted after manufacture. It is cleaned by vacuuming in situ or be easily removed for washing, if necessary.

The box 1 and the lid 2 are manufactured from 1.2 mm steel and are sufficiently rigid to ensure the quiet and reliable operation of the unit. The unit backplate on the floor of the box has four slot type punched holes for suspending the unit from underside of slab via drop rods.

The lid or access panel is openable to enable full access to all components, without the need to remove adjacent ceiling panels or tiles. The panel has push fit latches.

Although shown in the drawing as hinged at one end of the box, the panel can open sideways towards the wall ensuring full unencumbered access. For installation or major works the access panel can be easily removed.

A grille diffuser is present. Preferably this is a 3 or 4 slot adjustable linear diffuser, arranged to give airflow adjustment in two directions. The tubular blades are painted either white or black with the flange matt white. The grille is held in a fixed collar in the bulkhead and is arranged to have concealed fixings allowing adjustment of the internal vertical and horizontal damper blades. The grille when fixed will be tamperproof. A 70 or 140 mm adjustable flexible spigot connection shall be supplied between the unit and the grille.

On installation the controls are set in predetermined fashion. The controls are arranged to carry out diagnosis, so that a consumable component, such as a filter, can be cleaned before its useful life is over. Also, by virtue of the wiring and software the condition of components may be sensed remotely.

When there is a need the service engineer is called, the lid 2 is opened and dropped down and the engineer checks the control box and then replaces or rectifies the component as required.

The unit 20 shown in FIGS. 2 to 6 comprises a metal box 21 made of hot dipped galvanised steel. The box has a lid or access panel 22 made of stove enamelled mild steel and which is hinged at 23 to either longer side of the box. The lid is held shut using Allenkey locks 24 and a quick release safety cord 25 is present.

The box has a base 26, side walls and end walls. The base 26 (which is uppermost in the ceiling) has four slot type punched holes 27 by which the unit is suspended from the underside of the overlying slab 28 via drop rods 30 (this system is explained below in relation to FIGS. 4 and 5). The box has one end wall 31 adjacent the door D of a hotel bedroom, i.e. the unit is mounted in the ceiling of the lobby L of a hotel bedroom. The other end wall 32 has a grille 33 which is adjustable.

The box contains an external rotor motor and a scroll fan assembly 34. The fan and motor assembly is fitted with a high output permanent split capacitor continuously rated external rotor motor, with built-in thermal overload protection complying with BS 2048, 1961, Part 1 and BS 5000, 1973, Part 2. The motor is fitted with maintenance-free sealed-for-life bearings. Motors are insulated to B 2757 (Class B). The fan scrolls are double inlet, double width, centrifugal type steel impellers. The fan and motor assembly is statically balanced to prevent the transmission of vibration.

Each fan coil unit is set to operate at 4 speeds, ultra low, low, medium and boost. The speed control is achieved by variation of the voltage onto the fan motor, via Triacs and an eleven voltage Multi-tapped transformer 101 which incorporates a safety fuse for the control circuit.

Control of the four speeds and off position is incorporated in the room control plate 70 as explained below. This shows the desired speed and temperature with cooling signified by blue LED's, set point (default 21° C.) by green and heating by red. Wiring to the room control plate and any data communications is by Belden 8723 cable.

Behind the fan assembly are a heating coil and a cooling coil, each controlled by an associated damper plate. There are two circuits of pipework, one 35 for heating water and its damper 36 and the other 37 for cooling water and its damper 38. The cooling water circuit is lowermost. Each circuit contains an easily removable pipe length housing a strainer unit for ease of maintenance. The coils of the heat exchanger are manufactured from solid drawn copper tube, mechanically expanded into accurately pre-formed collars in aluminium fins. To ensure long life, the coil tube thickness is not less than 0.35 mm and aluminium fins not less than 0.12 mm. The coil has multiple circuits with headers. Each coil is fitted with extended accessible combined pressure test points/air vents and combined pressure test/drain points. All coils are tested after manufacture to 20 bar and are suitable for an operating pressure of up to 12 bar static head. They are fitted with 15 mm union connections.

A main condensate or drip tray 40 is present and an auxiliary condensate tray 41 extends from below the pipework to the main condensate tray 40 and is arranged so that water condensing on the pipework can flow into the main tray. The condensate drip tray is made from 1.2 mm hot dipped galvanised steel welded at each corner. The tray is degreased before an anti-condensation insulation is applied to all internal and external surfaces. The primary tray is fitted with 15 mm O/D plain tail brass connection. The condensate tray is fitted to ensure that all condensate drains effectively when the unit backplate is installed level. The main condensate tray includes a level pump 42 and a float switch 43. The unit is set to operate with a condensate lift pump 42 installed to lift the condensate up to 400 mm and for the condensate to then gravity drain. The pump 42 is energised by a signal from the PLC and will enunciate an alarm, via the float switch 43.

A filter panel 44 is present to the rear of the condensate tray 40. The filter is manufactured from a fine woven mesh of galvanised steel, welded to a rigid galvanised steel frame and painted after manufacture. The filter medium is mounted in the panel which is slid out of its frame 45 for replacement when required. It is cleaned by vacuuming in situ or removed for washing, if necessary. The filter panel 44 is easily removed by rotating cam levers on each side of the filter frame 45. An LED on the room control plate 70 will show filter dirty status.

A PLC unit 102 is mounted in drop down fashion on vertical rails on the inside of the end wall 31 of the box 21 above the door.

All components are held in place by quick release latches or snap fit locks. As a result, any one unit can be repaired or replaced as required.

Figure 4:
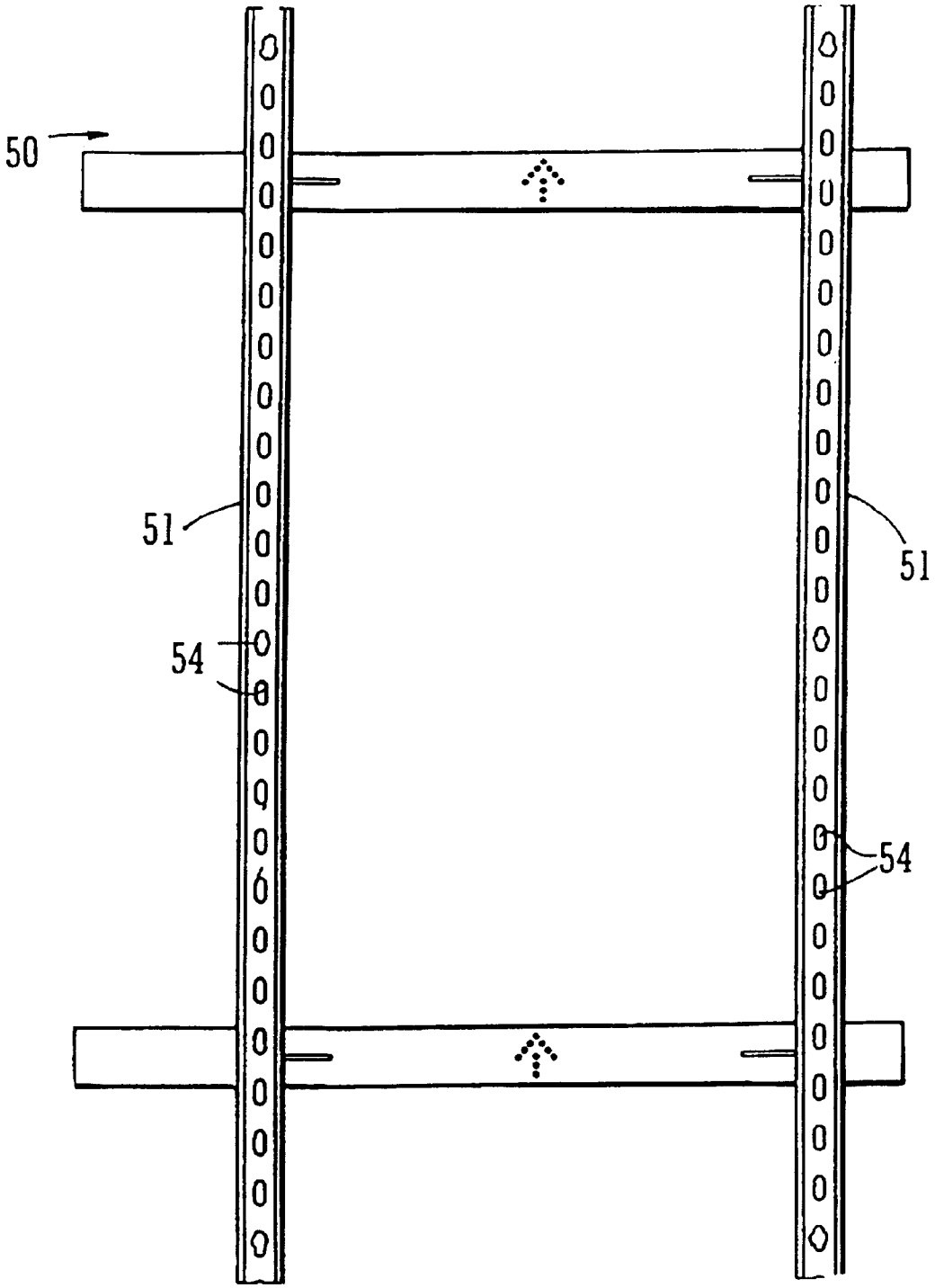
FIG. 4 is an underneath plan view of the mounting plate for mounting the unit before the unit is placed.
Figure 5:
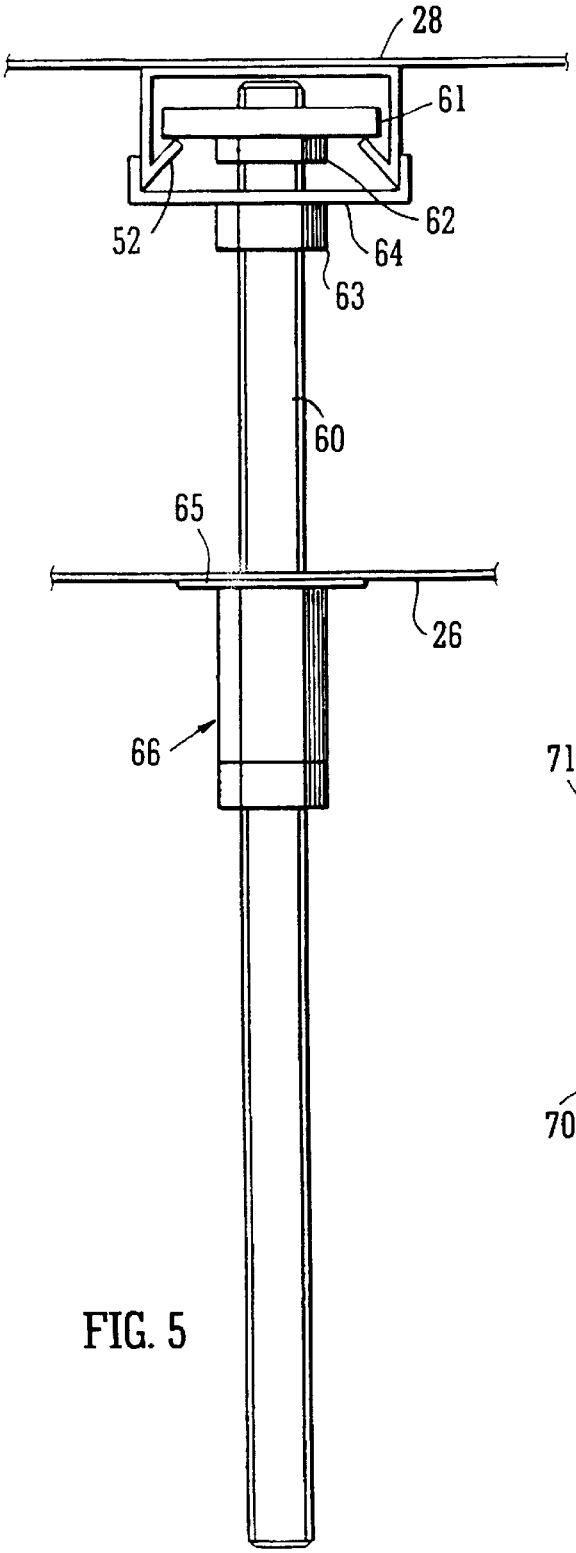
FIG. 5 is a vertical sectional view of one rib holding the unit to the mounting plate.

As shown in FIGS. 4 and 5 a mounting frame 50 has two tracks 51 each made of up of inverted channel section having inwardly turned margins 52. The floor 53 of the tracks has longitudinally spaced apart elongated holes 54. Four drop rods 60 are fixed to the track in assigned positions. Each rod is threaded to receive nuts. Each rod has a plate 61 below which is a nut 62; as shown the plate engages the margins 52 of the channel section, with the head of the rod in a hole 54 in the track and being locked in position by the nut 62. A nut 63 is present below the channel section track and is held against an outer plate 64.

The base 26 of the unit has four elongated holes 65, and is offered up so that the rods 60 pass through the holes; a nut 66 is then threaded up the rod. The nuts 66 on the four rods 60 are adjusted so that the unit is level so that condensate can flow into the condensate tray by gravity.

Figure 6:
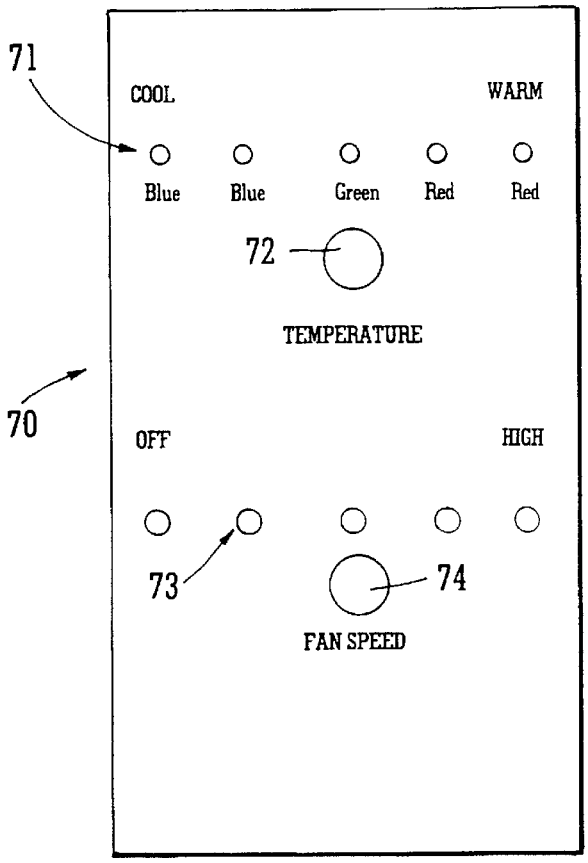
FIG. 6 is a plan view of a control panel.

The components are all hard wired connected to the PLC 102 which is programmed to monitor the state of each one and to provide a corresponding signal to LED lights on a control panel 70, shown in FIG. 6. A key feature of the invention is that the PLC is arranged to monitor the rate of rotation of the fan blades. Calculations have determined the speed required to achieve in particular climate control and if the actual demand on the fan is greater (as will be sensed by the speed of rotation), the PLC will be able to determine the cause, for example the level of blockage of the filter medium. In this way the rotation of the fan is used to monitor the condition of at least one other component for the filter unit. The panel 70 has an upper row 71 of LEDs above a temperature button 72 and a lower row 73 above a fan speed button 74. The upper row is colour coded to indicate temperature and the condition of the components.

An air sensor 100 is fitted in the return air stream, e.g. in the panel 22 in a location within the unit to ensure the room temperature is sensed. This will communicate with the PLC 102 in conjunction with the guest room control plate 70 to modulate the damper actuator (not shown) in the required sequence to maintain the set air temperature. In addition to temperature control, the PLC 102 can carry out fault diagnostic support for the following alarms; fan motor failure, condensate tray full and dirty filter (irrespective of fan speed), window open and unit unable to achieve/maintain design conditions for heating or cooling. In addition to the alarms, the controls can also identify the following status conditions via a front end building management system; condensate pump running, % filter dirty, % heating or % cooling, and bedroom door ajar. These will either be enunciated through LED's on the room dial plate or through the communicating DDC system.

The LEDs on the plate 70 can operate in the following way. If a component within the unit is not working correctly the top temperature Red 2 LED will flash. If this occurs one will hold the fan speed button for 10 seconds or until the LED's change. When the LED's have changed the following events or alarms will be shown:

| LED's | Event/Failure | Action Required |
|---|---|---|
| Blue 1 | Temperature Sensor Failure | Replace faulty sensor spares |
| Blue 2 | Window Open (if switch fitted) | Close window |
| Green | Condensate Pump Operating | None |
| Red 1 | Special Function | Clean Filter |
| Red 2 | Fan Motor Failure | Replace Fan |
| Other unit events that may occur include: | | |
| Blue 1 & 2 flashing | Outside normal operating band or >25° C. | Check chilled water flow temperature |
| Red 1 & 2 flashing | Outside normal operating band or <17° C. | Check hot water flow or temperature |

-continued

| LED's | Event/Failure | Action Required |
|---|---|---|
| Green Speed LED off | Unit speed turning to off | Check condensate tray for Drain line blockage or pump failure |
| Fan speed LED flashes | Filter dirty | Clean filter |

A discrete magnetic window and door contact switch is supplied loose for site wiring. When the window is opened, the fan coil unit can be programmed to either shift set points or to switch the unit off. The door contact will be used to energise the welcoming door entry lights in the access panel. The lights will automatically default to user control if the user decides to switch them off, otherwise they will automatically turn off after 4 minutes to conserve energy.

It will be noted that a service engineer need not visit the unit unless the control panel shows that there is a problem or a signal is sent to a master console. When the engineer needs to visit he can disengage any one component using the quick release locks and attend to it or replace it as required. Release of the access panel will trigger a signal to the master console so that the hotel can know if anyone is tampering with the equipment.

In summary, it will be seen that in its optimum form the invention provides a local means of monitoring the condition of the components in an air conditioning apparatus in each individual room; and easy local access to deal with any shortcomings without disrupting the use of the room for the prolonged period. It is no longer necessary to have a fill scale building management system, although of course this can be present.

In other words a unit of the invention is a modular intelligent hotel room system which is a platform for incorporating all mechanical and key electrical systems likely to be contained within the hotel bedroom lobby ceiling. The product is fully prefabricated, commissioned and tested off-site, allowing very quick installation into the bedroom lobby/hallway.

The room services can include:

heating, air conditioning, ventilation and room air filtration;

intake and discharge grilles;

energy efficiencies achieved through a variety of room sensors;

low voltage lobby lighting with the option of full intelligent lighting control;

electrical fused spur for power isolation of all unit mains items;

smoke detection;

alarm sounders with the option for room and remote annunciation;

fitting of sprinkler heads and prefabricated sprinkler pipework;

control over the majority of room services including temperature, ventilation, maintenance requirements with fault annunciation (either within the room or remotely), Make Up room, Room Service requests, Do Not Disturb, Door Bell and the like;

full sizes access panel permitting the rapid replacement of any component within the unit;

all necessary valves for automatically regulating water flow, strainers for cleaning the water, pressure test points, air vents, drains and isolating ball valves; all pre-assembled commissioned, tested and arranged to be easily removed from within the product;

the ability to provide a true on-line locking system using a variant of the room controller.

The unit enables the user:

to fully co-ordinate the many services within the typically narrow hotel bedroom lobby;

to deliver a pre-commissioned and tested unit that can very quickly be installed;

provide a variety of very quiet fan speeds;

to have intelligent attractive user-friendly controls to achieve and maintain the room temperature quickly;

to provide standardised operation with flexible options;

a to provide an unobtrusive yet attractive coordinated finish to the ceiling but still providing full access for all maintenance items;

to allow the production of accurate real-time maintenance reports based upon actual product sensor and rpm readings;

preventative maintenance using real time sensor feedback, thus reducing overall maintenance costs by focusing upon the actual areas that need maintenance;

the ability to remotely interrogate the product status without attending site.

The invention is not limited to the embodiments shown. Thus components may be replaced by their equivalents. The building need not be a hotel but can be any multi-room structure or area requiring individual air conditioning or heating.

What is claimed is:

1. A multi-room building, each room having an air conditioning unit for controlling the environment therein, the unit being mounted within the ceiling of the room, the unit comprising a housing containing components comprising, fan means, circuit means containing water, a condensation collection unit, air filter means, and process logic means arranged to monitor the condition of any one component, said housing having a door through which there is access to said components and said process logic means, said process logic means being mounted on a drop-down frame, each of said components being independently releasably mounted in said housing whereby each is individually replaceable.

2. A building according to claim 1, wherein access to said unit is by means of a door which is hinged to said housing.

3. A building according to claim 1, wherein said process logic means is arranged to monitor each of a variable speed motorised fan, a heat exchanger, an air filter and a transformer for varying the voltage supplied to the motor for the fan.

4. A building according to claim 1, wherein said process logic means is connected by hard wire to each of said components.

5. A building according to claim 1, wherein said unit includes an air sensor fitted to a return air stream to ensure that the true room air temperature is sensed and to provide a signal to said process logic means to drive an actuator to modulate damper means to maintain a preset air temperature.

6. A building according to claim 1, wherein said process logic means is arranged to send a signal to a control panel having light emitting diodes which indicate the condition of said components, and room temperature.

7. A building according to claim 5, wherein said process logic means includes diagnostic circuits to sense and activate an alarm signal in the event of a failure or threatened failure for one or more of the following components in said housing, a motor for the fan, a transformer, a filter element, the level of water in a condenser tray of heat exchangers when the room window is open, when the room door is open, and when the access panel is open.

8. A building according to claim 1, wherein a unit is mounted in the ceiling of the lobby of each room of the building.

9. A building according to claim 1, wherein said process logic means is connected to remote interrogation means, whereby the condition of all of said components may be interrogated remotely.

10. A unit for use in heating or cooling a room in a building, said unit comprising a housing containing fan means and a condensation tray to collect condensate formed in use of said unit, said unit being adapted to be suspended in the ceiling of the room by rod means depending from the overlying structure and passing through holes in the bounds of said housing and including adjustment means for mounting said unit in an assigned area in a ceiling of the room and locating said unit generally horizontal for collection of condensate in said condensation tray by gravity.

11. A building according to claim 1, wherein the housing is fitted within the ceiling, which has tiles or panels, whereby the door may be opened without the need to move ceiling tiles or panels.

* * * * *